US011111002B2

(12) United States Patent
Mills et al.

(10) Patent No.: US 11,111,002 B2
(45) Date of Patent: Sep. 7, 2021

(54) BOAT TOWER VENTILATION SYSTEM

(71) Applicants: Scott J. Mills, Kissimmee, FL (US); Richard W. Hord, Kissimmee, FL (US)

(72) Inventors: Scott J. Mills, Kissimmee, FL (US); Richard W. Hord, Kissimmee, FL (US)

( * ) Notice: Subject to any disclaimer, the term of this patent is extended or adjusted under 35 U.S.C. 154(b) by 0 days.

(21) Appl. No.: 16/722,596

(22) Filed: Dec. 20, 2019

(65) Prior Publication Data

US 2021/0188414 A1 Jun. 24, 2021

(51) Int. Cl.

| | |
|---|---|
| ***B63J 2/00*** | (2006.01) |
| ***B63J 2/02*** | (2006.01) |
| ***B63B 19/04*** | (2006.01) |
| ***B63B 15/00*** | (2006.01) |

(52) U.S. Cl.
CPC ..... *B63J 2/02* (2013.01); *B63B 15/00* (2013.01); *B63B 19/04* (2013.01)

(58) Field of Classification Search
CPC ..... B63B 15/00; B63B 19/00; B63B 19/04; B63B 19/06; B63J 2/00; B63J 2/02; B63J 2/10
USPC ..... 114/211, 343, 361, 364, 173, 177, 178
See application file for complete search history.

(56) References Cited

U.S. PATENT DOCUMENTS 6,712,689 B2 * 3/2004 Clarkson ..... B63J 2/04 114/211
7,954,443 B2 * 6/2011 Mason ..... B63B 19/00 114/361

* cited by examiner

*Primary Examiner* — Daniel V Venne
(74) *Attorney, Agent, or Firm* — William M. Hobby

(57) ABSTRACT

A boat tower ventilation system for a boat tower to ventilate behind a windshield such as the cockpit area in a tower or the like. Air ventilation units are built into the tower frame and may be opened or closed to the flow of air.

11 Claims, 8 Drawing Sheets

BOAT TOWER VENTILATION SYSTEM

FIELD OF THE INVENTION

This invention relates to boat towers and especially to a ventilation system for boat towers having windshields isolating the cockpit area in the tower.

BACKGROUND OF THE INVENTION

Many boats have frames extending above the hull of the boat. Such structures are generally attached to the boat and referred to as boat towers. Boat towers may be in the form of wake towers, T-top frames, fishing towers, conventional fishing platforms, biminis or racks. Many boat towers also have windshields and side windows made of glass or a polymer material to protect against sea spray, rain and wind. Such towers commonly have tops or covers further isolating the cockpit area of the tower.

Boat towers with windshields tend to isolate the cockpit area of the boat which allows for the build up of heat and can allow condensation to build up in the cockpit area. What is needed is an effective ventilation system to ventilate the area behind the windshield and to cool the person in the cockpit area of the boat.

The present invention is for a boat tower on a boat which has ventilation units integral to the boat tower frame members which can be manually or automated to open or close to let air flow in a predetermined direction into the boat cockpit area.

SUMMARY OF THE INVENTION

An air ventilation system for a boat tower has an air ventilation body fitted into an extruded or cast boat tower frame member which air ventilation body is shaped to fit into the extruded or cast boat tower frame member. The air ventilation body has a passageway therethrough. A passageway cover is hinged to the air ventilation body and has a closed position to block the passage of air therethrough and an open position to open the passageway to the flow of air therethrough. The air ventilation body is elongated and each end has a shaped end portion which can be press fitted into the extruded upright tower frame member extrusion or casting channel between two sections of the frame. An air ventilation system for a boat tower is thus integrated into a boat tower frame member. The air ventilation body has a stop ledge in the passageway for positioning the cover in a closed position. The air ventilation body has a cover seal to seal the cover over said passageway when the cover is closed. The air ventilation body passageway is curved to direct air in a predetermined area into the cockpit of a boat.

BRIEF DESCRIPTION OF THE DRAWINGS

The accompanying drawings, which are included to provide further understanding of the invention, are incorporated in and constitute a part of the specification and illustrate an embodiment of the invention and together with the description serve to explain the principles of the invention.

In the drawings.

DETAILED DESCRIPTION OF AN EXEMPLARY EMBODIMENT

The present invention is for an air ventilation system for a boat tower on a boat having a windshield isolating the cockpit area in the boat.

Figure 1:
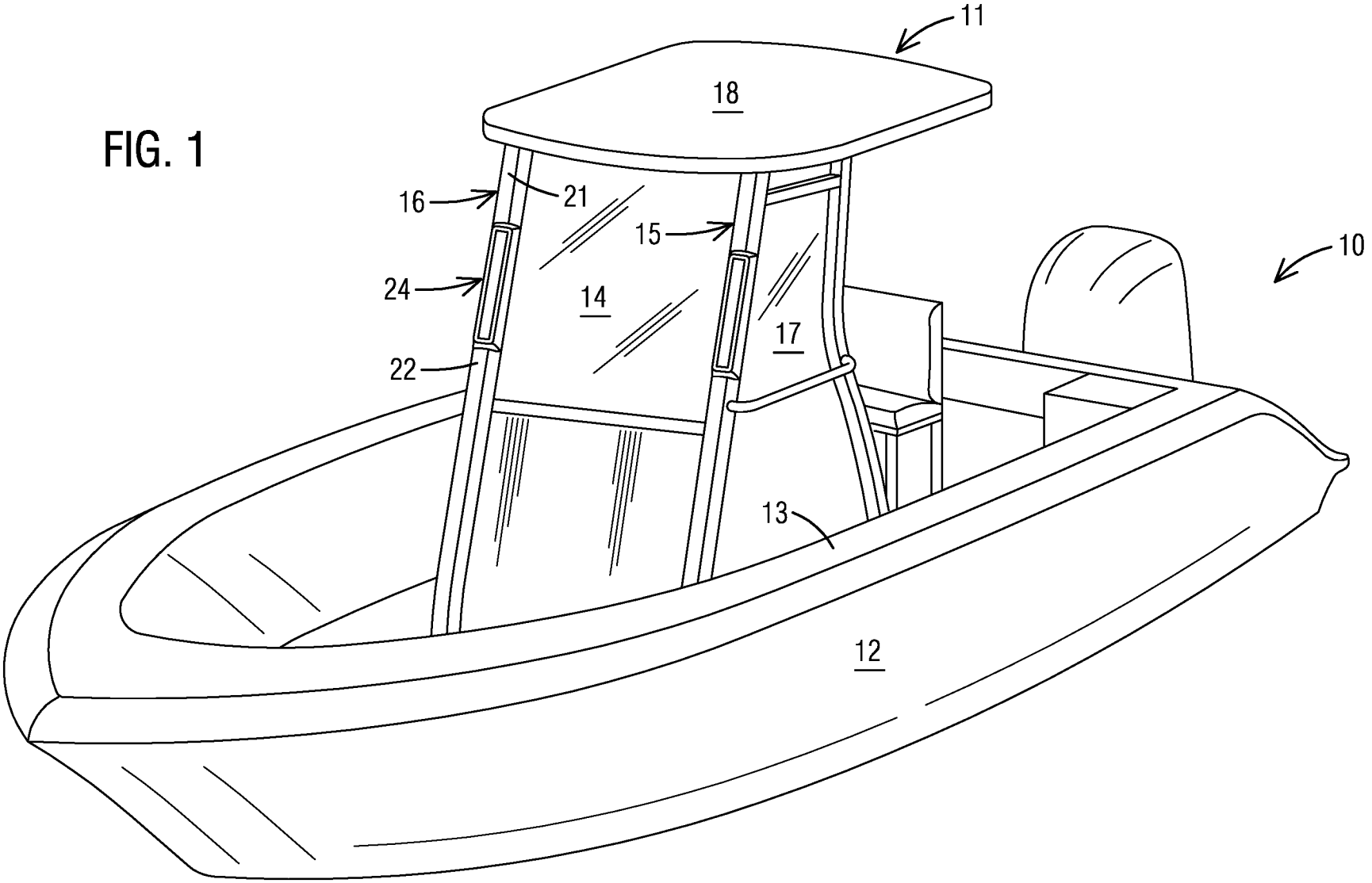
FIG. 1 is a perspective view of a boat having a boat tower having air ventilation units in the frame in accordance with the present invention.
Figure 2:
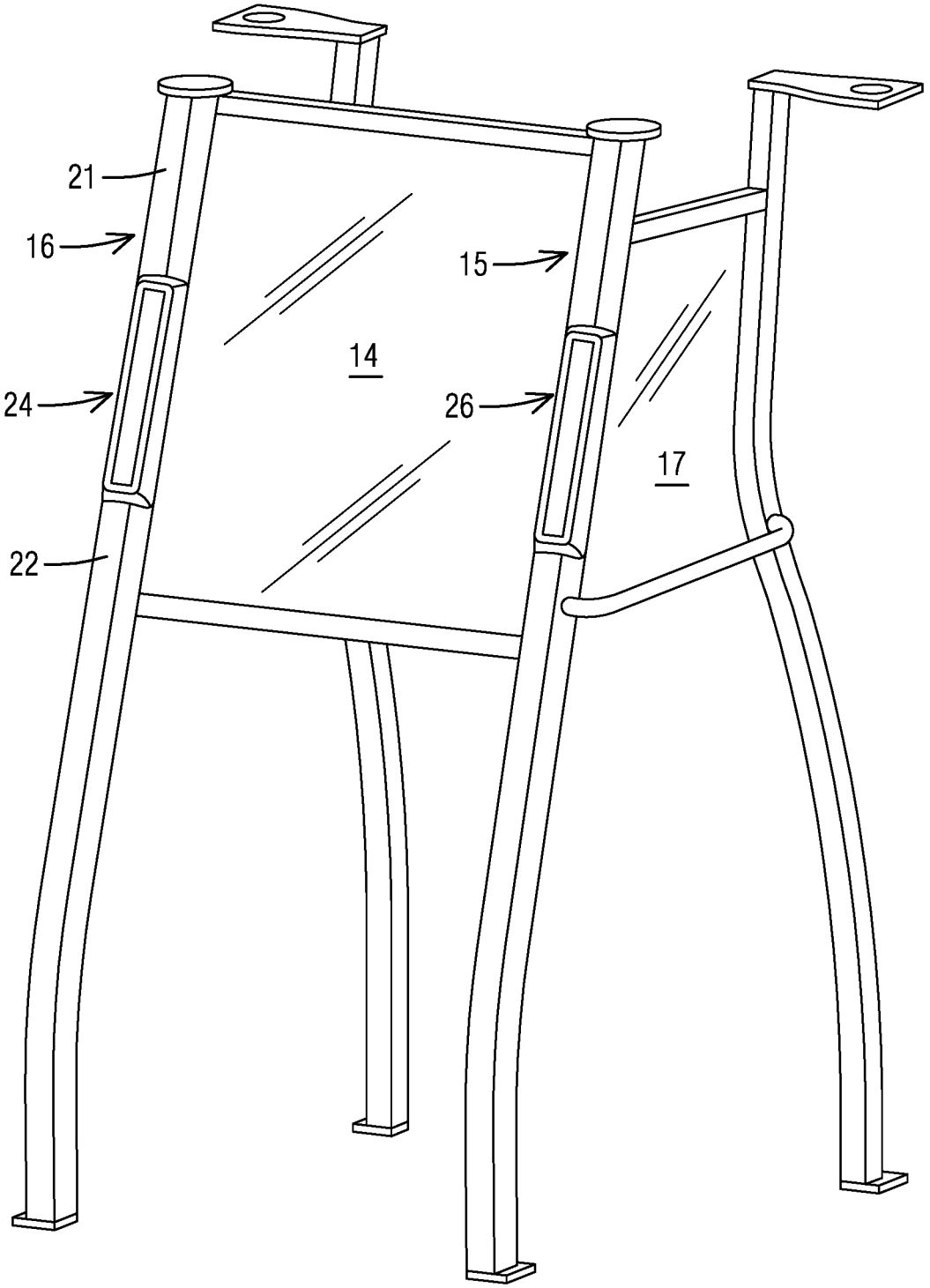
FIG. 2 is a perspective view of the boat tower of FIG. 1.
Figure 3:
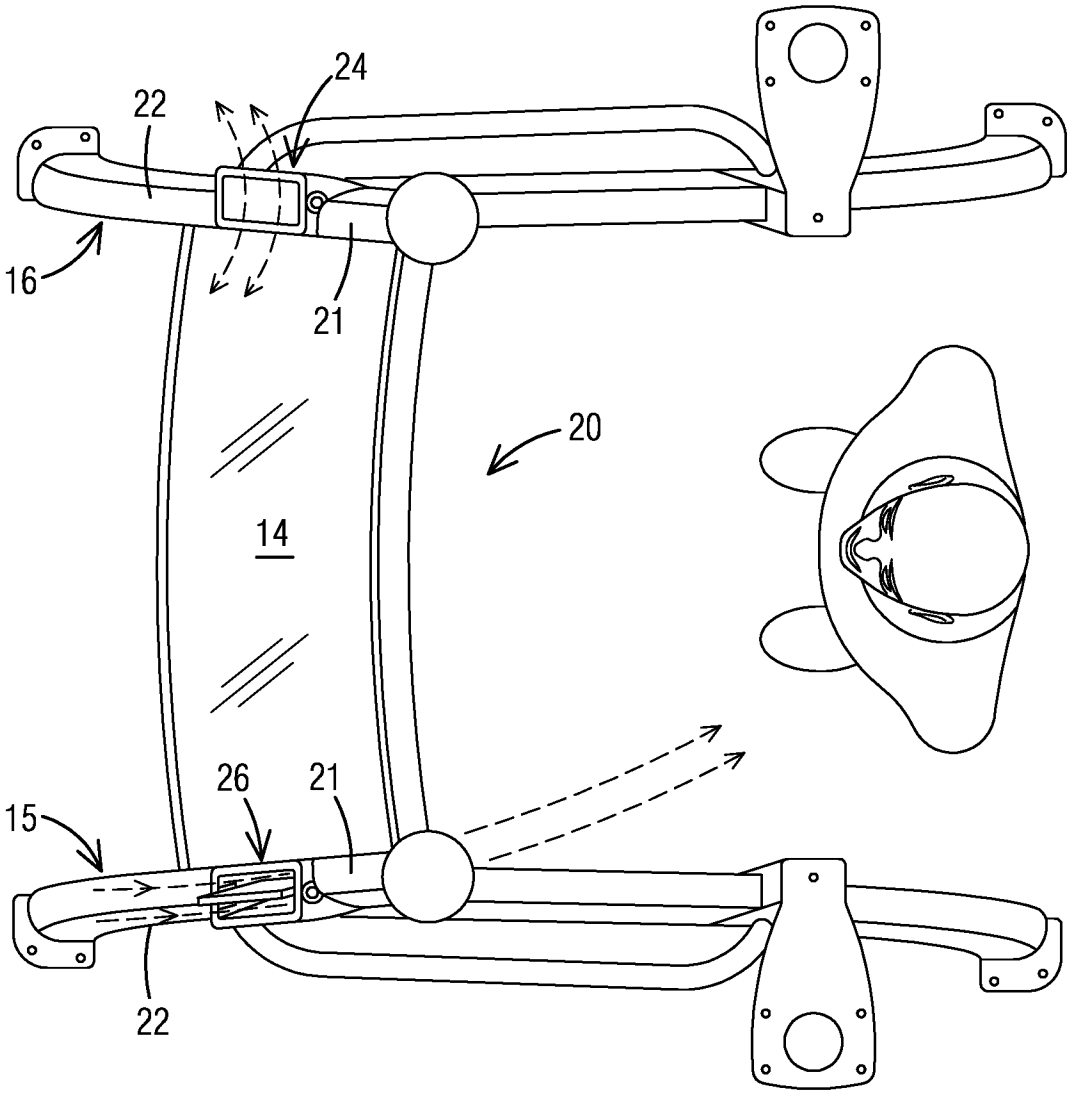
FIG. 3 is a top elevation of the boat tower of FIGS. 1 and 2 illustrating the flow of air through air ventilation units.

Referring to the drawings FIGS. 1 through 7 and especially to FIG. 1, a boat 10 has a boat tower 11 thereon. The boat 10 has a hull 12 with a gunnel 13. The tower 11 is shown mounted inside the gunnel but can just as well be mounted to the gunnel. The boat tower 11 has a translucent windshield 14 mounted to tower frame members 15 and 16 and a pair of side translucent windows 17 and a cockpit cover 18. A cockpit 20 as seen in FIG. 3 is located behind the tower 11 windshield 14. The cockpit of the boat 10 is typically located in the boat tower 11.

Figure 6:
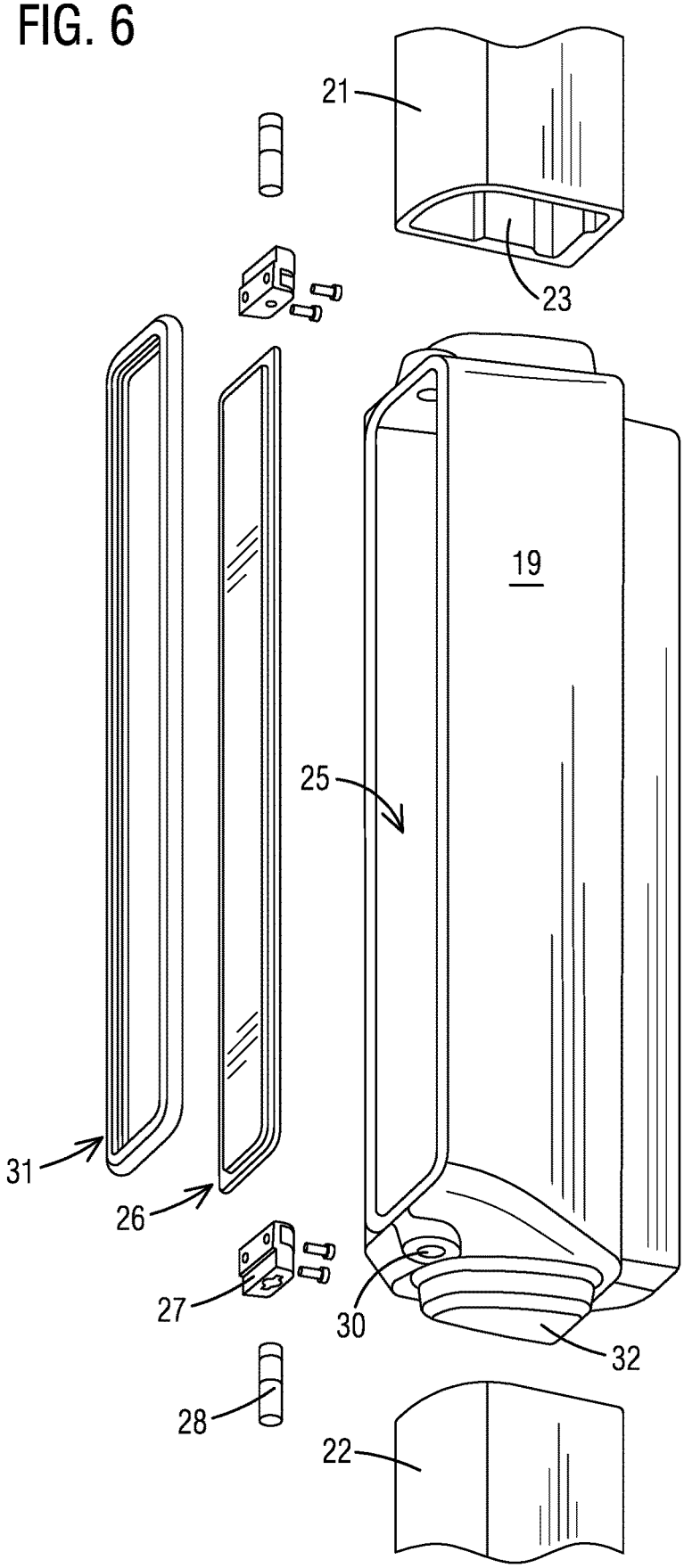
FIG. 6 is an exploded perspective view of the air ventilation unit.

The boat tower 11 frame upright members 15 and 16 are made up of two extrusion members 21 and 22, such as aluminum extrusions, each having extrusion channels 23 running through the center thereof as seen in FIG. 6.

Figure 4:
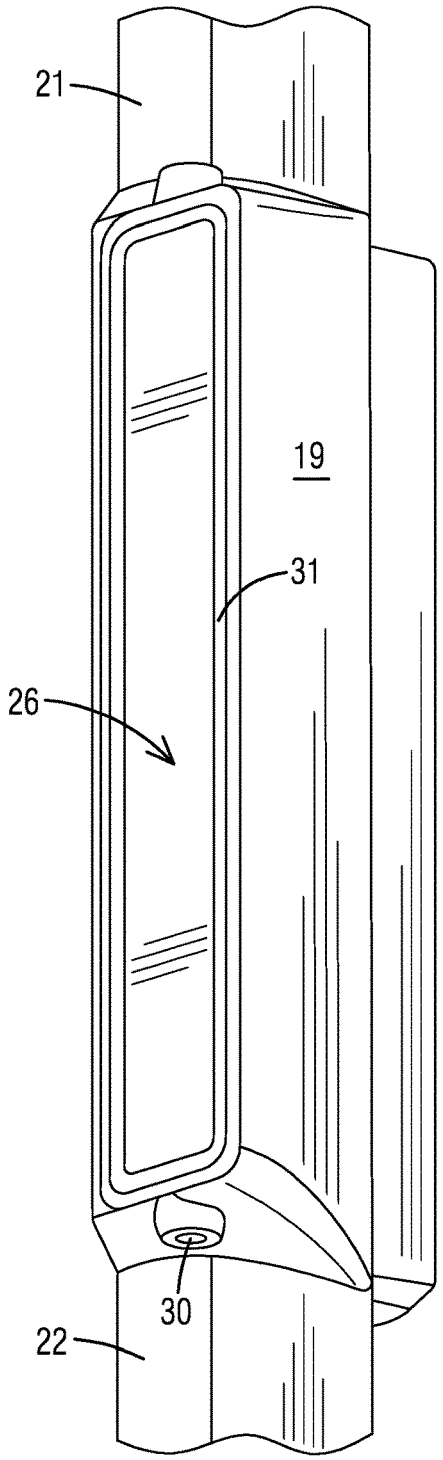
FIG. 4 is a partial perspective view of the air ventilation unit installed in a frame member with the air ventilation unit passageway cover in a closed position.
Figure 5:
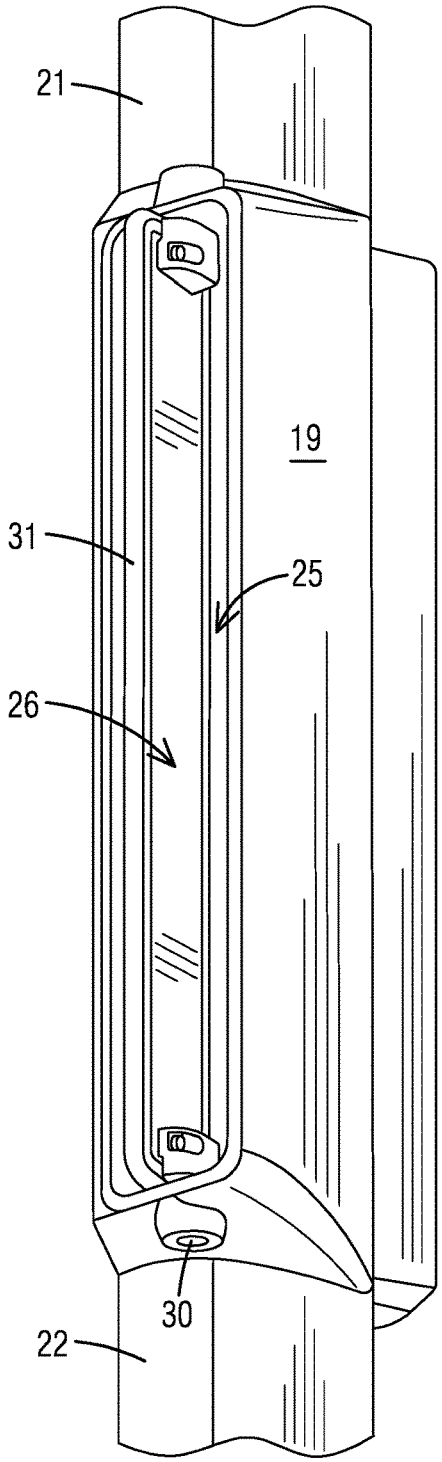
FIG. 5 is a partial perspective view of the air ventilation unit installed in a frame member with the air ventilation unit passageway cover in an open position.
Figure 7:
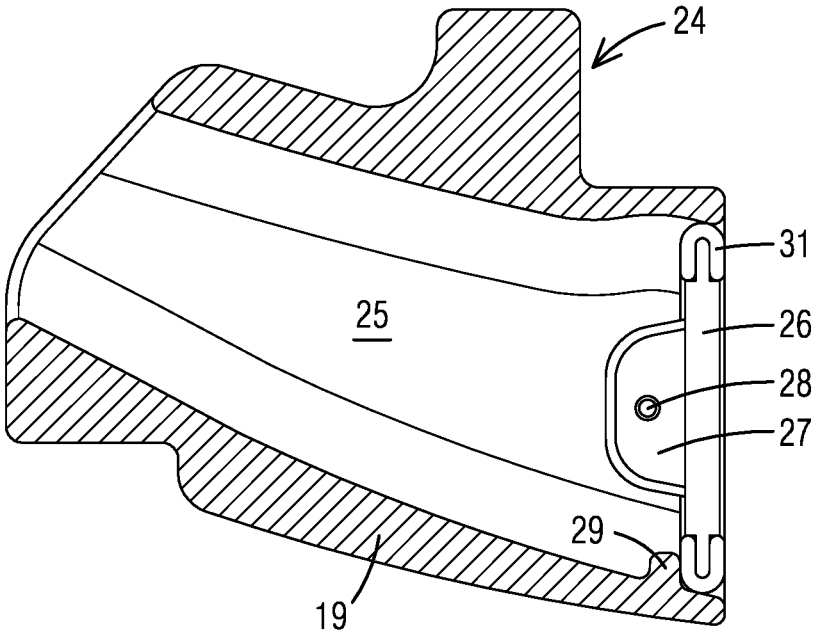
FIG. 7 is a sectional view taken through the air ventilation unit with the ventilation unit cover in a closed position.
Figure 8:
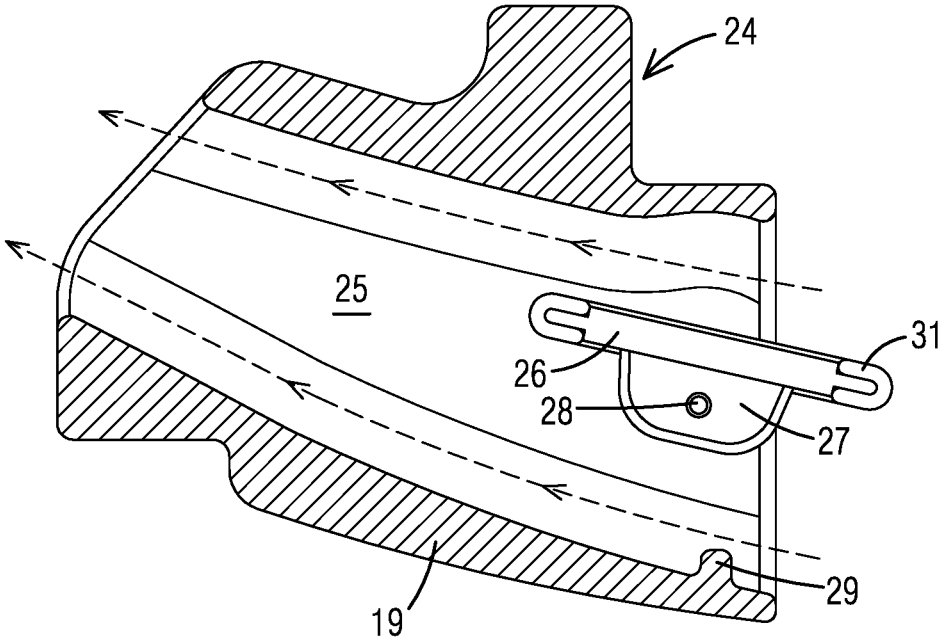
FIG. 8 is a sectional view taken through the air ventilation unit with the ventilation passageway cover in an open position.

A tower ventilation unit 24 is mounted in each tower front upright frame member 15 and 16 between the extrusion members 21 and 22. Each tower ventilation unit 24 has a body 19 having a passageway 25 shaped to direct air therethrough as seen in FIGS. 3, 6 and 7 and 8, in a predetermined direction into the cockpit area 20. Each tower ventilation unit 24 has a passageway ventilation door or cover 26 which is hinged with hinge member 27 which includes a friction hinge pin 28 which fits in a hinge aperture 30 as seen in FIGS. 4, 5 and 6. The hinged ventilation passageway cover 26 includes a ventilation cover seal 31 which allows the ventilation passageway cover 26 to be rotated on hinge 27 to close the ventilation passageway 25 and seal it against the edges of the walls of the passageway 25. The passageway cover 26 abuts a ledge 29 in a closed position as seen in FIGS. 7 and 8. Each tower ventilation unit 24 body 19 has a shaped end member 32 on each end thereof as seen in FIG. 6 which is shaped to be press fitted into the channel 23 of the extrusion members 21 and 22. Thus each tower air ventilation unit becomes an integral part of the tower frame member 15 and 16. The tower ventilation unit passageway cover 26 is manually rotated between an open and a closed position as desired to obtain ventilation in the cockpit area 20 as seen in FIGS. 4 and 5. The ventilation passageway 25 in the tower ventilation unit is curved as seen in FIGS. 7 and 8 to direct air to a person in the cockpit area.

Figure 9:
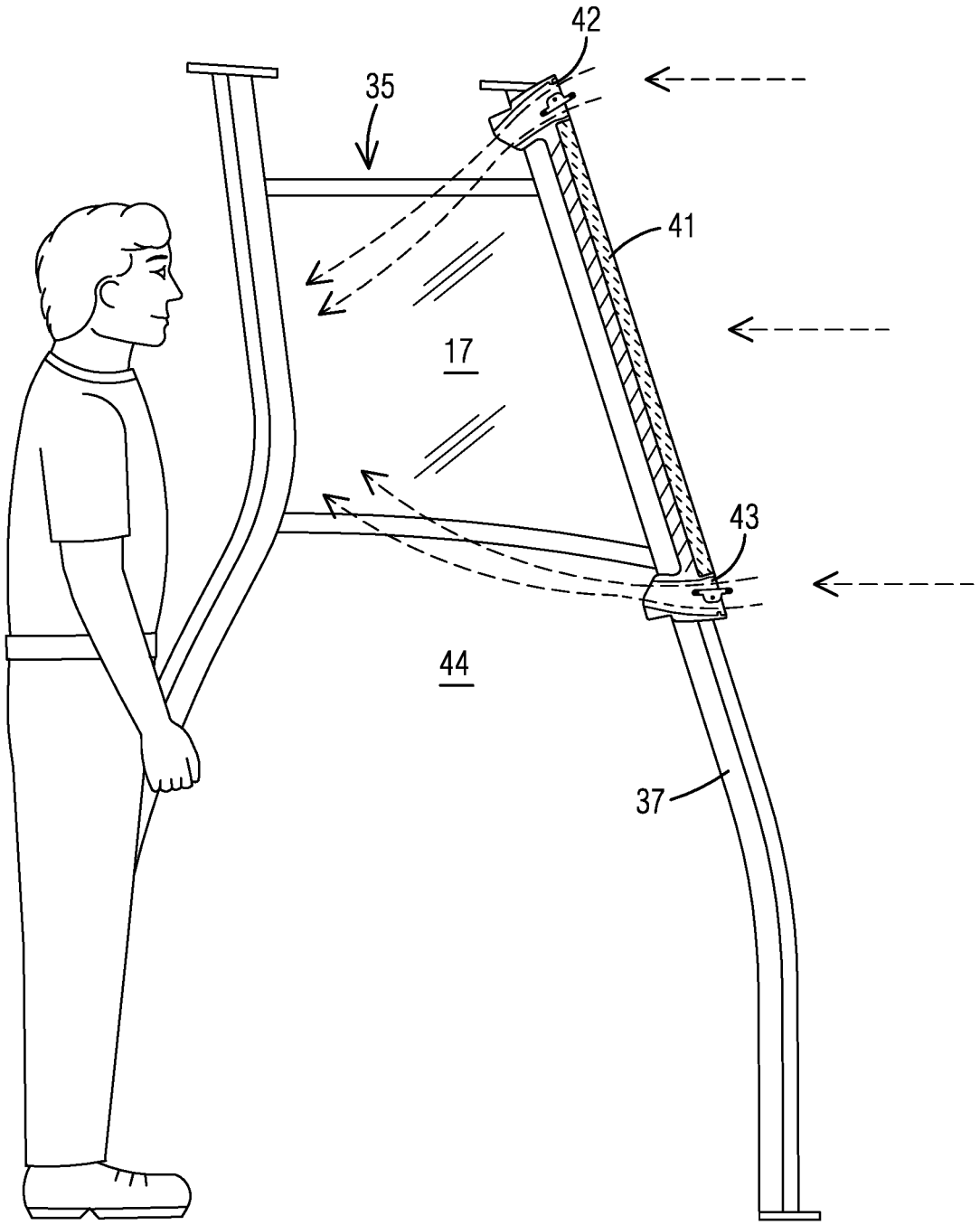
FIG. 9 is a sectional view of an alternate embodiment taken through the boat tower.
Figure 10:
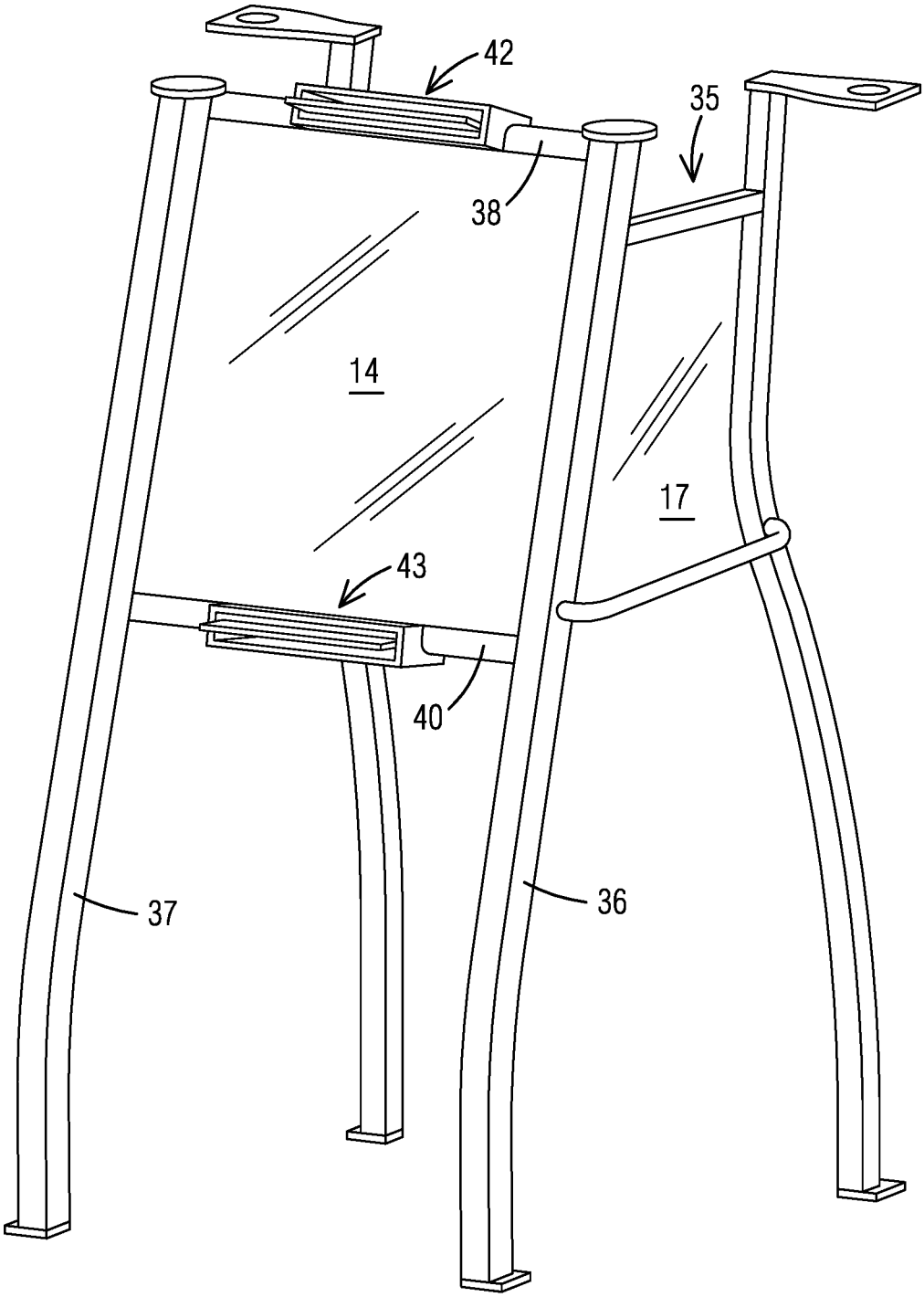
FIG. 10 is a perspective view of the boat tower of FIG. 9.

An alternate embodiment is illustrated in FIGS. 9 and 10. A boat tower 35 has front frame members 36 and 37. Front horizontal cross frame members 38 and 40 support a glass or acrylic windshield 41 as does frontal frame members 36 and

37. The horizontal frame member 38 has a top air ventilation unit 42 incorporated therein in the same manner as tower ventilation unit 24 of FIGS. 1 through 6. An air ventilation unit 43 is integrated into bottom horizontal frame member 40. This allows the ventilation of the cockpit area 44 from above and below the windshield 41. The top and bottom tower ventilation units 42 and 43 are the same as the tower ventilation units 24 but with different curved passageways producing the ventilation air flow as seen by the arrows in FIG. 9. Each tower ventilation unit 42 and 43 has the same ventilation passageway cover and seal as shown in FIGS. 4 through 8.

It should be clear at this time that a boat tower ventilation system which is integral to the boat tower frame has been provided. However the present invention is not to be considered limited to the forms shown which are to be considered illustrative rather than restrictive.

We claim:

1. An air ventilation unit for a boat tower comprising:

an air ventilation body for an extruded tower frame member, said air ventilation body shaped to fit into said extruded tower frame member, and having a passageway therethrough to allow air to flow therethrough and said air ventilation body having a passageway cover hinged thereto having a closed position to block air from passing therethrough and an open position to allow the flow of air therethrough and said air ventilation body having two ends and having an end portion on each end shaped to be press fitted into one section of said extruded frame member between two sections of said extruded tower frame member;

whereby said air ventilation unit can be fitted into said extruded tower frame member.

2. The air ventilation unit for a boat tower in accordance with claim 1 in which said air ventilation body passageway cover has a cover seal to seal said cover over said passageway.

3. The air ventilation unit for a boat tower in accordance with claim 2 in which said air ventilation body passageway has a ledge positioned therein for one edge of said passageway cover to rest on when said passageway cover is in a closed position.

4. The air ventilation unit for a boat tower in accordance with claim 3 in which each said air ventilation unit is shaped to fit into a front upright frame member.

5. The air ventilation unit for a boat tower in accordance with claim 3 in which each said air ventilation unit is shaped to fit into a horizontal frame member.

6. A boat tower ventilation system comprising:

a boat tower frame having two upright frame members;

a windshield attached to each of said two upright frame members;

an air ventilation unit body formed as a frame member section and mounted in each upright frame member, each said air ventilation body having a passageway therethrough and shaped for directing air to an area behind said windshield, each said passageway having an opening thereinto and each air ventilation body having a cover hinged thereto and positioned to cover said opening into said air ventilation body passageway, said cover having an open position allowing passage of air through said passageway and a closed position blocking the passage of air through said passageway;

whereby ventilation can be selectively directed behind a boat tower windshield.

7. The boat tower ventilation system in accordance with claim 6 in which said boat tower has a cover and side translucent windows attached thereto.

8. The boat tower ventilation system in accordance with claim 6 in which each said air ventilation unit body has a cover seal to seal said air ventilation passageway in a closed position.

9. A boat tower ventilation system comprising:

a boat tower frame having two upright frame members and two front horizontal cross frame members;

a windshield attached to each of said two front horizontal cross frame members;

an air ventilation unit formed as a front horizontal cross frame member section and mounted in each said front horizontal cross frame member, each said air ventilation unit having a passageway therethrough and shaped for directing air to an area behind said windshield, and each air ventilation unit having a cover hinged thereto and positioned to block said air ventilation unit passageway, and having an open position allowing passage of air through said passageway and a closed position blocking the passage of air through said passageway;

whereby ventilation can be selectively directed behind a boat tower windshield.

10. The boat tower ventilation system in accordance with claim 9 in which said boat tower frame has a cockpit cover and side translucent windows attached thereto.

11. The boat tower ventilation system in accordance with claim 9 in which each said air ventilation unit has a ventilation cover seal to seal said air ventilation unit passageway in a closed position.

* * * * *